US008019264B2

(12) United States Patent
Murayama

(10) Patent No.: US 8,019,264 B2
(45) Date of Patent: Sep. 13, 2011

(54) IMAGE-FORMING APPARATUS HAVING FLEXIBLE SHEET GUIDE

(75) Inventor: Tatsuomi Murayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 981 days.

(21) Appl. No.: 11/829,683

(22) Filed: Jul. 27, 2007

(65) Prior Publication Data

US 2008/0292371 A1 Nov. 27, 2008

(30) Foreign Application Priority Data

Aug. 3, 2006 (JP) ..... 2006-212614

(51) Int. Cl.
*G03G 15/16* (2006.01)

(52) U.S. Cl. ..... 399/316

(58) Field of Classification Search ..... 399/316, 399/388

See application file for complete search history.

(56) References Cited

U.S. PATENT DOCUMENTS 5,594,539 A 1/1997 Murano

FOREIGN PATENT DOCUMENTS

| | | | |
|---|---|---|---|
| JP | 63-073251 | U | 5/1988 |
| JP | 05-257395 | | 10/1993 |
| JP | 08-076607 | | 3/1996 |
| JP | 2000-229748 | A | 8/2000 |
| JP | 2001-356538 | A | 12/2001 |
| JP | 2002-014550 | A | 1/2002 |
| JP | 2008-003445 | A | 1/2008 |

*Primary Examiner* — David M Gray
*Assistant Examiner* — Laura K Roth
(74) *Attorney, Agent, or Firm* — Canon USA Inc IP Division

(57) ABSTRACT

An image-forming apparatus includes an image-bearing member supporting a toner image, a transfer portion at which the toner image on the image-bearing member is transferred on a sheet; and first and second guides that guide the sheet to the transfer portion and respectively have first and second contact portions so that a surface of the sheet on which the toner image is transferred contacts these portions. The first contact portion is located at an upstream side of the second contact portion in a sheet-conveying direction. After a rear end of the sheet passes the first contact portion, the rear end of sheet passes the second contact portion while bending the second guide toward the image-bearing member. The second guide is bent from a position of an upstream side in the sheet-conveying direction with respect to a position of the first contact portion.

8 Claims, 7 Drawing Sheets

IMAGE-FORMING APPARATUS HAVING FLEXIBLE SHEET GUIDE

BACKGROUND OF THE INVENTION

1. Field of the Invention

The present invention relates to image-forming apparatuses that form images on sheets.

2. Description of the Related Art

Image-forming apparatuses such as copiers, printers, and facsimiles can transfer a toner image on an image-bearing member. In such an image-forming apparatus, a sheet is conveyed to a transfer portion and the toner image is transferred on the sheet.

At this time, when the toner image is transferred on the sheet at the transfer portion, a transfer condition depends on a behavior of the sheet to be transferred at the transfer portion. To stabilize the behavior of the sheet to be conveyed, various suggestions are made.

For example, a pre-transfer guide is provided at the upstream side of the transfer portion. The pre-transfer guide allows the sheet to enter the transfer portion while regulating the behavior of the sheet. Accordingly, the toner image is transferred on the sheet in a stable manner.

However, in the case where such a pre-transfer guide is provided, if the sheet is thick and hard, the posture of the sheet may be rapidly changed toward the image-bearing member when the rear end of the sheet passes through the pre-transfer guide. In such a case, a horizontal line may appear in an image to be transferred on the sheet due to a shock caused by the change in posture of the sheet.

For example, a configuration is provided in which an elastic member is provided at a tip end of the pre-transfer guide, and the elastic member reduces the rapid change in posture of the sheet so as to prevent the horizontal line from appearing on the sheet (e.g., see Japanese Patent Laid-Open Nos. 08-076607 (corresponding to U.S. Pat. No. 5,594,539) and 05-257395).

Meanwhile, when the sheet is being transferred and is in a posture such that a portion of the sheet at the upstream side of the transfer portion extends along the image-bearing member, the sheet may contact the toner image on the image-bearing member before the transfer, and accordingly, the sheet may rub the image and deteriorate the image.

The rubbing of the sheet against the toner image on the image-bearing member at the upstream side of the transfer portion may occur particularly in a configuration in which a belt serves as the image-bearing member, and a nip between the belt and a transfer roller serves as the transfer portion. To realize good transcription for various types of sheets, the contact pressure of the transfer roller with respect to the belt bearing the toner image is necessary to be increased. If the contact pressure at the transfer portion is increased, a nip width of the belt and the transfer roller at the transfer portion may be increased. Owing to this, the sheet may be conveyed to extend along an extension of the nip, or along the belt at the upstream side of the transfer portion.

In such a configuration where the belt serves as the image-bearing member, since the sheet is in the posture extending along the belt, the sheet may contact the toner image on the belt at the upstream side of the transfer portion. Owing to this, the sheet may rub the image on the belt and deteriorate the image. Even when a cylindrical photosensitive drum is used as the image-bearing member, for instance, when an image is formed on a curved sheet, the image rubbing may still occur.

To regulate the posture of the sheet, if a guide for guiding a surface of the sheet facing the image-bearing member at the upstream side of the transfer portion is arranged at a position distant from the image-bearing member, the sheet does not contact toner images on the image-bearing member before the transfer, thereby preventing the sheet from rubbing the images on the image-bearing member so that the images would not be deteriorated. However, since the position of the guide is distant from the image-bearing member, the change in posture of the sheet when the rear end of the sheet passes through the guide becomes further rapid, and the accompanying shock may increase the occurrence of a horizontal line in the images.

As described above, it is difficult to solve both problems such as the image rubbing due to the contact between the sheet and the toner images on the image-bearing member occurring while the pre-transfer guide guides the sheet from its tip end portion to its rear end portion, and the occurrence of the horizontal line due to the shock applied when the rear end of the sheet passes through the pre-transfer guide.

SUMMARY OF THE INVENTION

The present invention is directed to an image-forming apparatus capable of reducing contact between a sheet and a toner image on an image-bearing member, and reducing occurrence of a line appearing at a rear end portion of the sheet.

According to an aspect of the present invention, an image-forming apparatus includes an image-bearing member supporting a toner image, a transfer portion at which the toner image on the image-bearing member is transferred on a sheet, a first guide, and a flexible second guide. The first guide guides the sheet to the transfer portion and has a first contact portion. A surface of the sheet on which the toner image is transferred contacts the first contact portion. The second guide guides the sheet to the transfer portion. The second guide has a second contact portion. The surface of the sheet on which the toner image is transferred contacts the second contact portion. The first contact portion is located on an upstream side of the second contact portion in a sheet-conveying direction. After a rear end of the sheet passes the first contact portion, the rear end of sheet passes the second contact portion while causing the second guide to bend toward the image-bearing member. The second guide is bent from a position of an upstream side in the sheet-conveying direction with respect to a position of the first contact portion which the rear end of the sheet finally contacts when the rear end of the sheet passes the first contact portion.

The present invention may reduce the deterioration of the toner image on the image-bearing member caused by the contact between the sheet and the toner image, and may reduce the occurrence of a line appearing in the image at the rear end portion of the sheet.

Further features of the present invention will become apparent from the following description of exemplary embodiments with reference to the attached drawings.

DESCRIPTION OF THE EMBODIMENTS

Exemplary embodiments of the present invention are described below with reference to the attached drawings.

First Embodiment

Figure 1:
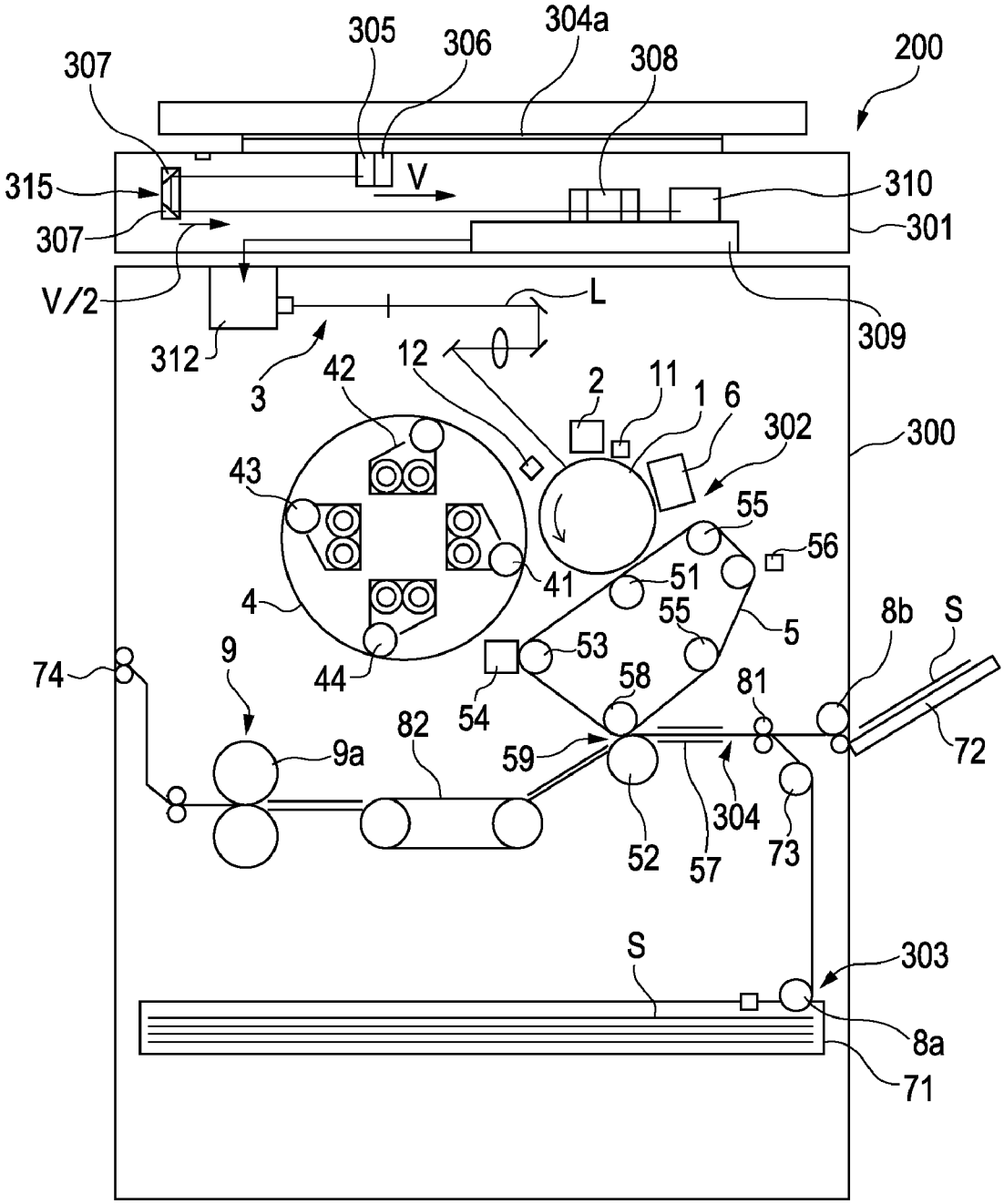
FIG. 1 is a schematic illustration showing a configuration of an image-forming apparatus having a sheet-conveying device according to a first embodiment of the present invention.

FIG. 1 is a schematic illustration showing a configuration of an image-forming apparatus having a sheet-conveying device according to a first embodiment of the present invention.

In FIG. 1, reference numeral 200 denotes an image-forming apparatus, and reference numeral 300 denotes an image-forming apparatus main body (hereinafter, referred to as a main body). An image reader 301 is provided above the main body 300. The image reader 301 reads an original placed on a platen glass 304*a* serving as an original table.

The image reader 301 includes a light source (not shown), such as a halogen lamp or a fluorescent lamp, for illuminating the original, a carriage 306 having a mirror 305 for reflecting light from the light source, and a carriage 315 having a mirror 307.

To read an image of the original, the carriage 306 is moved at a speed V in a direction indicated by an arrow during illumination provided by the light source, and the carriage 315 is moved at a speed V/2 in a direction indicated by an arrow, so that the entire original is scanned. The light that has scanned the original is reflected by the mirrors 305 and 307 and focused on a charge coupled device (CCD) 310 by a lens 308. Then, the image of the original read by the CCD 310 is converted into electric signals by an image processing unit 309, and the signals are transmitted to an exposure system 3 (described below).

The main body 300 includes an image-forming unit 302, a sheet-feeding unit 303 that feeds a sheet S, and a sheet-conveying device 304 that conveys the sheet S fed by the sheet-feeding unit 303 to the image-forming unit 302, and more specifically, to a secondary transfer portion 59 (described below). The main body 300 also includes a fixing unit 9, a conveying belt 82 that conveys the sheet S, on which a full-color toner image has been transferred, to the fixing unit 9. In this embodiment, a surface layer of a heating roller 9*a* of the fixing unit 9 is covered with a fluorocarbon resin tube instead of rubber. Accordingly, the life of the fixing unit 9 may be prolonged.

The image-forming unit 302 includes a cylindrical photosensitive drum 1, a pre-exposure lamp 11, a corona primary charger 2, and a rotary developer 4. The photosensitive drum 1 is rotatable in a direction indicated by an arrow. The rotary developer 4 has therein a plurality of developers 41 to 44 that are integrally formed with toner cartridges.

Also, the image-forming unit 302 has an endless intermediate transfer belt 5 and a secondary transfer roller 52. Four color toner images successively formed by the photosensitive drum 1 are primarily transferred on the intermediate transfer belt 5 one after another. The secondary transfer roller 52 secondarily transfers the toner images, which have been primarily transferred on the intermediate transfer belt 5, on the sheet S. The intermediate transfer belt 5 is hung across a driving roller 53, a driven roller 55, and a driven secondary-transfer inner roller 58. A nip between the intermediate transfer belt 5 and the secondary transfer roller 52 define the secondary transfer portion 59 for the transfer of the toner images, which have been provided on the intermediate transfer belt 5, on the sheet S.

Also, the image-forming unit 302 has an electric potential sensor 12, a primary transfer roller 51, a cleaner 6, and the like. The primary transfer roller 51 primarily transfers the toner images, which have been formed on the photosensitive drum 1, on the intermediate transfer belt 5. The exposure system 3 includes a laser driver 312 and a polygonal mirror (not shown), etc. The polygonal mirror allows a laser beam emitted from the laser driver 312 to perform horizontal scanning.

The sheet-feeding unit 303 is provided at a bottom portion of the main body 300 and includes a cassette 71 and a feeding roller 8*a*. The cassette 71 houses sheets S and is detachably mounted at the main body 300. The feeding roller 8*a* feeds the sheets S housed in the cassette 71. In addition, a manual sheet-feeding tray 72 and a manual sheet-feeding roller 8*b* are provided at the side surface of the main body 300. The sheets S are put on the manual sheet-feeding tray 72 and are fed by the manual sheet-feeding roller 8*b*. Each sheet S is supplied to the sheet-conveying device 304 from the cassette 71 or the manual sheet-feeding tray 72.

The sheet-conveying device 304 has a registration roller 81 and a pre-secondary-transfer guide 57. The registration roller 81 increases the positional accuracy of the posture of the sheet S so as to feed the sheet S corresponding to the toner images provided on the intermediate transfer belt 5. The pre-secondary-transfer guide 57 guides the sheet S fed by the registration roller 81 to the secondary transfer portion 59.

Next, an image formation operation of the image-forming apparatus 200 having the above-mentioned configuration is described below.

When the image of the original is read by the image reader 301, image signals corresponding to the colors (yellow, magenta, cyan, black) are transmitted to the exposure system 3. The laser driver 312 modulates a semiconductor laser element (not shown) in accordance with the image signals.

Accordingly, the semiconductor laser element emits laser beams L corresponding to the colors. The laser beams L scan the photosensitive drum 1 via a polygonal mirror (not shown) or the like.

At this time, the photosensitive drum 1 is previously charged by the corona primary charger 2 to have a predetermined polarity and a predetermined voltage. Electrostatic latent images are formed on the photosensitive drum 1 upon the irradiation of the laser beams. The plurality of developers 41 to 44 arranged in the rotary developer 4 form the toner images of selected colors. The toner images formed on the photosensitive drum 1 are primarily transferred on the intermediate transfer belt 5 by the primary transfer roller 51 at a transfer position.

In full-color mode, for example, the yellow developer 41 is arranged at a position facing the photosensitive drum 1 to develop an electrostatic latent image of yellow as a first color. The yellow developer 41 forms a yellow toner image on the photosensitive drum 1 as a first color image. A transfer bias voltage having a polarity opposite to that of the toner is applied to the primary transfer roller 51. Accordingly, the yellow toner image is primarily transferred on the intermediate transfer belt 5.

The intermediate transfer belt 5 having the yellow toner image transferred thereon is rotated by the driving roller 53, so that the next toner image is formed and transferred thereon. Meanwhile, the rotary developer 4 is rotated counterclockwise so that the next developer of a specified color faces the photosensitive drum 1 to prepare for developing the next electrostatic latent image. In this way, in the full-color mode, the formation, development, and transfer of the electrostatic latent image are repeated until a predetermined number of toner images are transferred.

The developers 41 to 44 are supplied with toners in a desired timing from toner containers (hoppers) of required colors disposed near the exposure system 3 such that the toner ratio (or toner amount) in each developer is held constant.

A control unit (not shown) rotates the feeding roller 8*a* and a conveying roller 73 in a predetermined timing to feed a sheet S from the cassette 71. The registration roller 81 of the sheet-conveying device 304 corrects the skew of the sheet S, and the sheet S is fed to the secondary transfer portion 59 defined by the intermediate transfer belt 5 and the secondary transfer roller 52, via the pre-secondary-transfer guide 57 in an appropriate timing.

The secondary transfer roller 52 secondarily transfers the full-color toner images provided on the intermediate transfer belt 5, on the sheet S fed to the secondary transfer portion 59. After the secondary transfer, the conveying belt 82 conveys the sheet S to the fixing unit 9. Then, the fixing unit 9 applies heat and pressure to the sheet S to permanently fix the transferred unfixed images to the sheet S. A discharge roller 74 discharges the sheet S with the images fixed from the main body 300.

A transfer cleaner 54 pinches the intermediate transfer belt 5 with the driving roller 53. The completed images of the selected colors are superposed on the intermediate transfer belt 5. After the transfer onto the sheet S, the transfer cleaner 54 cleans up the toners remaining on the intermediate transfer belt 5. The intermediate transfer belt 5 after the secondary transfer is used for the primary transfer again after the transfer cleaner 54 cleans up the residual toners.

A detector 56 detects the positional shifting and the color depth of the images transferred from the photosensitive drum 1. Based on signals sent from the detector 56, the control unit continuously gives an instruction to the image-forming unit 302 to correct the image color depth, toner supplying amount, image writing timing, image wiring start position, and the like.

Figure 3:
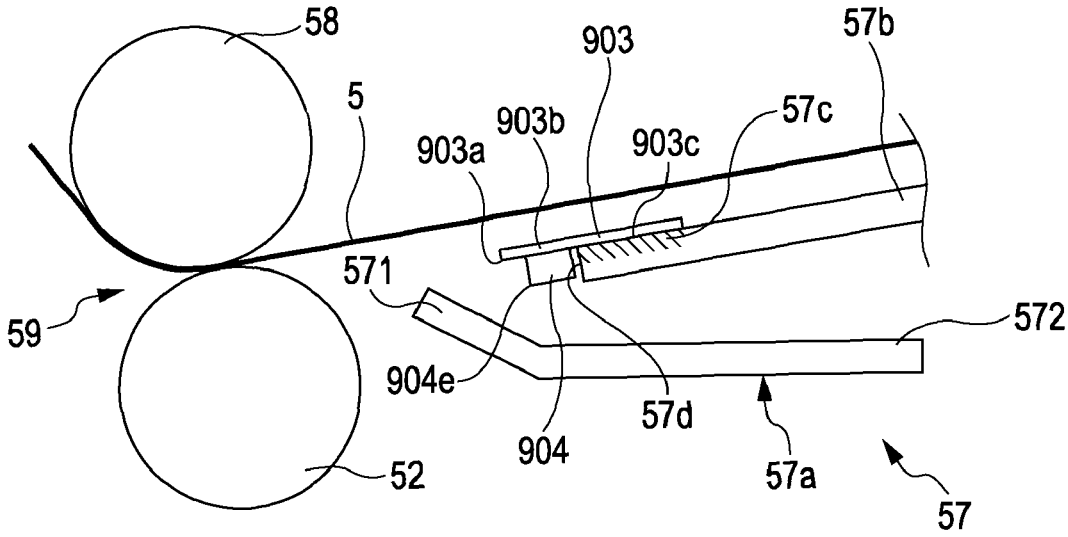
FIG. 3 is an explanatory view showing a configuration of a pre-secondary-transfer guide provided at the sheet-conveying device according to an embodiment of the present invention.

Next, configurations of the secondary transfer portion 59 and the pre-secondary-transfer guide 57 provided at the upstream side of the secondary transfer portion 59 in the sheet-conveying device 304 are described with reference to FIG. 3.

The pre-secondary-transfer guide 57 provided at the upstream side of the secondary transfer portion 59 has an upper guide 57*b*. The upper guide 57*b* guides the sheet S conveyed by the registration roller 81 (see FIG. 1) to the secondary transfer portion 59. The upper guide 57*b* can be made of a metal plate, and in this embodiment, it is made of iron.

A sheet 903 can be made of polyethylene terephthalate (hereinafter, referred to as a PET sheet), which is a flexible member with a thickness of about 50 μm, is attached to the upper surface of the upper guide 57*b* at a tip end portion thereof. The PET sheet 903 is attached to the upper surface of the upper guide 57*b* such that a tip end portion 903*b* thereof protrudes toward the downstream side in the sheet-conveying direction from an end of the upper guide 57*b*.

In particular, a bonding portion 903*c* of the PET sheet 903 is attached to a stationary portion 57*c* indicated by oblique lines illustrated at the upper surface of the upper guide 57*b*, and the PET sheet 903 is fixed to the upper guide 57*b* with an adhesive. The tip end portion 903*b* located at the downstream side of a downstream end 57*d* of the stationary portion 57*c* of the upper guide 57*b* in the sheet-conveying direction is flexible upon application of a pressure of a sheet. That is, the tip end portion 903*b* of the PET sheet 903 may be elastically deformed from the downstream end 57*d* toward the intermediate transfer belt 5 with respect to the upper guide 57*b*. In this embodiment, the downstream end 57*d* of the stationary portion 57*c* of the upper guide 57*b* is an end of the upper guide 57*b*.

The PET sheet 903 may be fixed to the upper guide 57*b* with screws instead of using an adhesive.

In addition, a regulation member 904 is attached to the lower surface (facing a lower guide 57*a*) of the protruding tip end portion 903*b* of the PET sheet 903. The regulation member 904 serves as a regulation portion that regulates the movement of the PET sheet 903 toward the intermediate transfer belt 5. In this embodiment, for example, a PET member having a thickness of about 600 μm (with a bonding layer having a thickness of about 100 μm) is attached as the regulation member 904 on which the conveyed sheet slides. The regulation member 904 (first guide) protrudes from the lower surface of the tip end portion 903*b* of the PET sheet 903 (second guide) by the thickness of the regulation member 904. The regulation member 904 is a protrusion protruding from the tip end portion 903*b* of the PET sheet 903, the tip end portion 903*b* being a flexible portion in the PET sheet 903, to the side opposite to the intermediate transfer belt 5. The material of the regulation member 904 is not limited to the PET member and may be other resins. The material of the regulation member 904 may be metal so as to reduce the friction thereof against the sheet.

A tip end 903*a* (second contact portion) of the PET sheet 903 is located at the downstream side of a lower edge 904*e* (first contact portion) of the regulation member 904 in the sheet-conveying direction, and near the intermediate transfer belt 5 as compared with the location of the lower edge 904*e* of the regulation member 904. Namely, the regulation member 904 is located at the side of the PET sheet 903 facing the lower guide 57*a*, and at the upstream side of the tip end 903*a* of the PET sheet 903 in the sheet-conveying direction.

The pre-secondary-transfer guide 57 has the lower guide 57*a* for guiding the sheet to the secondary transfer portion 59, the lower guide 57*a* contacting the lower surface of the sheet opposite to the intermediate transfer belt 5. The lower guide 57*a* includes a downstream portion 571 and an upstream portion 572. The downstream portion 571 is inclined toward the intermediate transfer belt 5 relative to the upstream portion 572. Accordingly, the downstream portion 571 may guide the tip end of the sheet to the intermediate transfer belt 5.

Next, the behavior of the sheet at the pre-secondary-transfer guide 57 is described below with reference to FIGS. 5A to 5C.

Figure 5A:
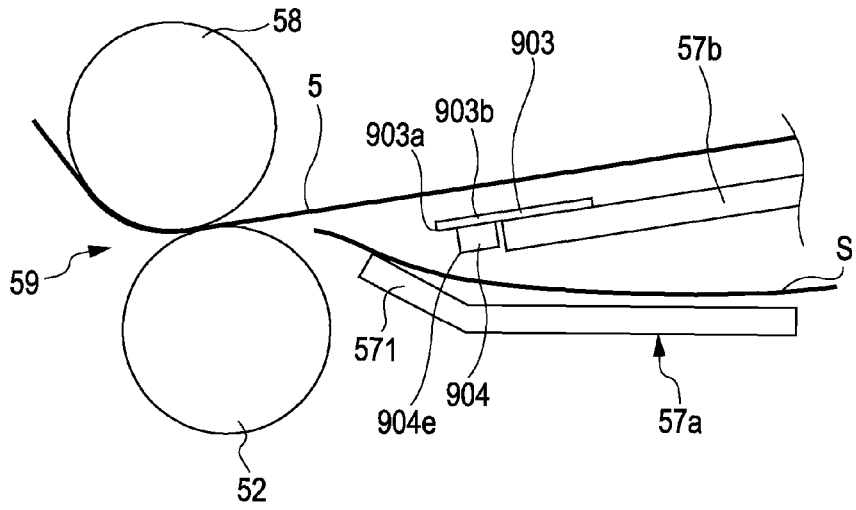
FIG. 5A is an explanatory view showing a state before a sheet reaches a secondary transfer portion of the image-forming apparatus according to the first embodiment.
Figure 5B:
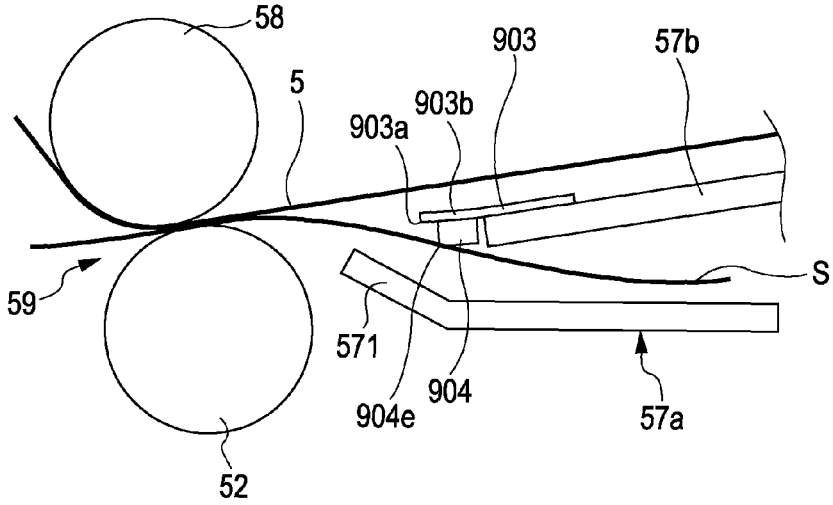
FIG. 5B is an explanatory view showing a state before a rear end of the sheet passes the regulation portion during transfer of an image at the secondary transfer portion of the image-forming apparatus according to the first embodiment.

As shown in FIG. 5A, a sheet S conveyed by the registration roller 81 (see FIG. 1) is guided by the upper guide 57*b* and the lower guide 57*a*, and conveyed to the secondary transfer portion 59.

The secondary transfer portion 59 transfers the toner images onto the sheet S when the sheet S reaches the secondary transfer portion 59. During the image transfer onto the sheet S at the secondary transfer portion 59, a portion of the sheet S at the upstream side of the secondary transfer portion 59 tends to be bent toward the intermediate transfer belt 5 in a convex manner due to the nip pressure applied at the secondary transfer portion 59. As shown in FIG. 5B, the lower edge 904*e* of the regulation member 904 regulates the sheet S so as not to be bent toward the intermediate transfer belt 5. At this time, the PET sheet 903 is elastically deformed slightly due to the pressure applied by the sheet S.

The lower edge 904*e* of the regulation member 904 supports the sheet S so as to be away from the intermediate transfer belt 5 in a period from when the tip end of the sheet S enters the secondary transfer portion 59 until when the rear end of the sheet S reaches the regulation member 904 of the upper guide 57*b*. That is, as shown in FIG. 5*b*, the sheet S is supported (regulated) such that the sheet S is pushed down by the regulation member 904 so as to be away from the intermediate transfer belt 5. Accordingly, a contact area between the sheet S and the intermediate transfer belt 5 at the upstream side of the secondary transfer portion 59 becomes small. Since the lower edge 904*e* of the regulation member 904 regulates the bending of the sheet S toward the intermediate transfer belt 5, the contact area between the sheet S and the intermediate transfer belt 5 at the upstream side of the secondary transfer portion 59 becomes small. Accordingly, defective image transfer caused by rubbing of the sheet S against the intermediate transfer belt 5 at the contact area may be reduced.

Figure 5C:
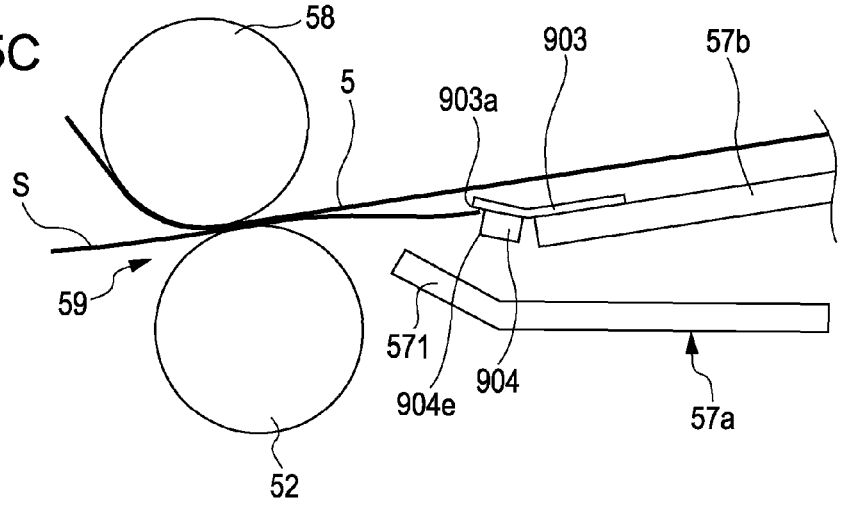
FIG. 5C is an explanatory view showing a state when the rear end of the sheet passes the regulation portion during the transfer of the image at the secondary transfer portion of the image-forming apparatus according to the first embodiment.

When the rear end portion of the sheet S is conveyed while being regulated by the regulation member 904 and passes the regulation member 904, as shown in FIG. 5C, the rear end portion of the sheet S contacts the tip end 903*a* of the PET sheet 903 as an elastic member. At this time, due to the hardness (elasticity) of the sheet S, the rear end portion of the sheet S causes a force that pushes up the tip end portion 903*b* of the PET sheet 903 to extend along the intermediate transfer belt 5. With this force, the tip end portion 903*b* of the PET sheet 903 is bent due to its elasticity, and accordingly, the regulation member 904 and the rear end portion of the sheet S are moved toward the intermediate transfer belt 5.

The reason why the posture of the rear end portion of the sheet S is rapidly changed to come close to the intermediate transfer belt 5 after the sheet S passes the regulation member 904 is as follows. The lower edge 904*e* of the regulation member 904 located at the downstream side regulates the sheet S so as not to be bent toward the intermediate transfer belt 5 in a convex manner until when the rear end of the sheet S passes the regulation member 904. When the rear end of the sheet S passes the regulation member 904, the sheet S is released from the regulation of the regulation member 904. Accordingly, the posture of the rear end portion of the sheet S is rapidly changed to move toward the intermediate transfer belt 5.

As shown in FIG. 5C, since the tip end portion 903*b* of the PET sheet 903 including the regulation member 904 is bent toward the intermediate transfer belt 5, the rear end portion of the sheet S guided to the PET sheet 903 moves to a position near the intermediate transfer belt 5. Therefore, the rapid change in posture of the sheet can be reduced when the rear end of the sheet S passes the PET sheet 903. As a result, a horizontal line can be prevented from appearing in the images to be transferred on the sheet S.

After the rear end of the sheet S passes the tip end portion 903*b* of the PET sheet 903, the PET sheet 903 is restored to a shape in a free state due to the elasticity of the PET sheet 903.

In the above-described embodiment, the regulation member 904 is positioned such that the regulation member 904 regulates the movement of the sheet S until when the rear end of the sheet S passes the regulation member 904, and after the rear end of the sheet S passes the regulation member 904, the rear end of the sheet S may pass the regulation member 904 while causing the PET sheet 903 to be bent toward the intermediate transfer belt 5.

Since the movement of the sheet is regulated until when the rear end of the sheet passes the regulation member 904, the sheet to be conveyed can be prevented from contacting the toner images provided on the intermediate transfer belt 5 and from deteriorating the images by rubbing. In addition, after the rear end of the sheet passes the regulation member 904, the rear end of the sheet passes the regulation member 904 while causing the PET sheet 903 to be bent toward the intermediate transfer belt 5. Accordingly, a line can be prevented from appearing in the images due to a shock of the change in posture of the sheet when the rear end of the sheet passes the regulation member 904, thereby forming good images.

The tip end portion 903*b* (flexible portion) of the PET sheet 903 extends to the downstream end thereof from a position thereof at the upstream side of the lower edge 904*e* of the regulation member 904 that regulates the movement of the sheet toward the intermediate transfer belt 5. In other words, since the flexible portion of the PET sheet 903 is elongated in the sheet-conveying direction, a bending amount of the PET sheet 903 due to the pressure applied by the rear end portion of the sheet S may be sufficiently provided.

Accordingly, the tip end 903*a* of the PET sheet 903 guides the sheet at a position close to the intermediate transfer belt 5. Accordingly, the line can be further reliably prevented from appearing in the images due to a shock applied when the rear end of the sheet passes through the pre-secondary-transfer guide 57.

In the above description, the PET sheet 903 and the regulation member 904 are individual members and attached to each other. Alternatively, a member having the functions of the PET sheet 903 and regulation member 904 may be provided. With this configuration, advantages similar to those described above may be attained.

While the PET sheet is used as a member for receiving the rear end portion of the sheet while being bent, the member may be made of rubber or the like as long as the member has elasticity. While the cross section of the lower edge 904*e* located at the downstream end of the regulation member 904 is rectangular, the cross section may be an arc. While the cross section of the tip end portion of the PET sheet 903*b* has square corners, the cross section may be an arc.

Figure 4A:
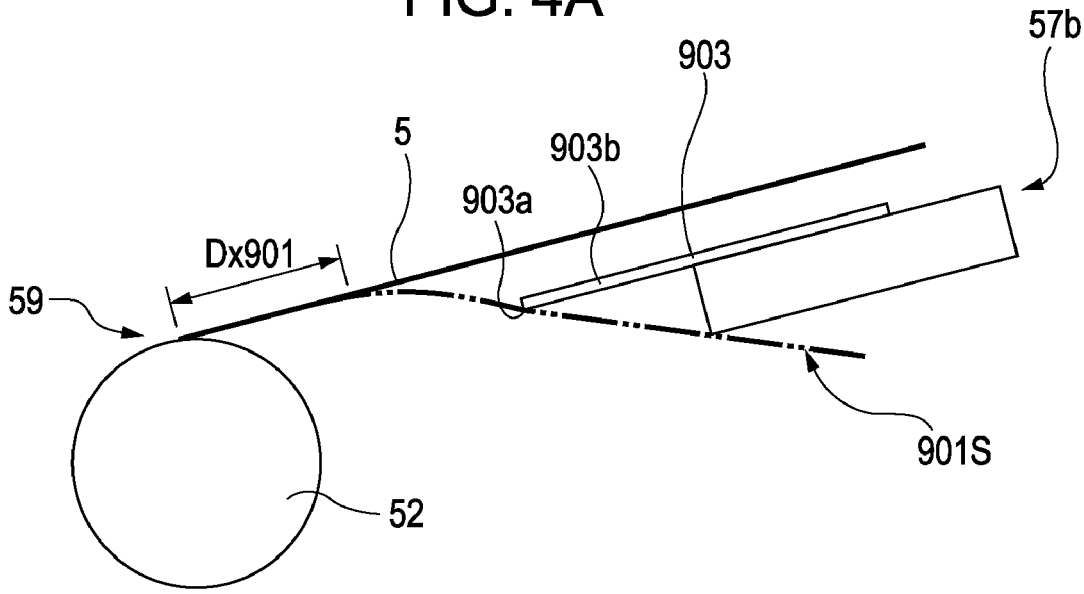
FIG. 4A is an explanatory view showing a behavior of a sheet when passing through the pre-secondary-transfer guide in a case where a PET sheet has no regulation portion.
Figure 4B:
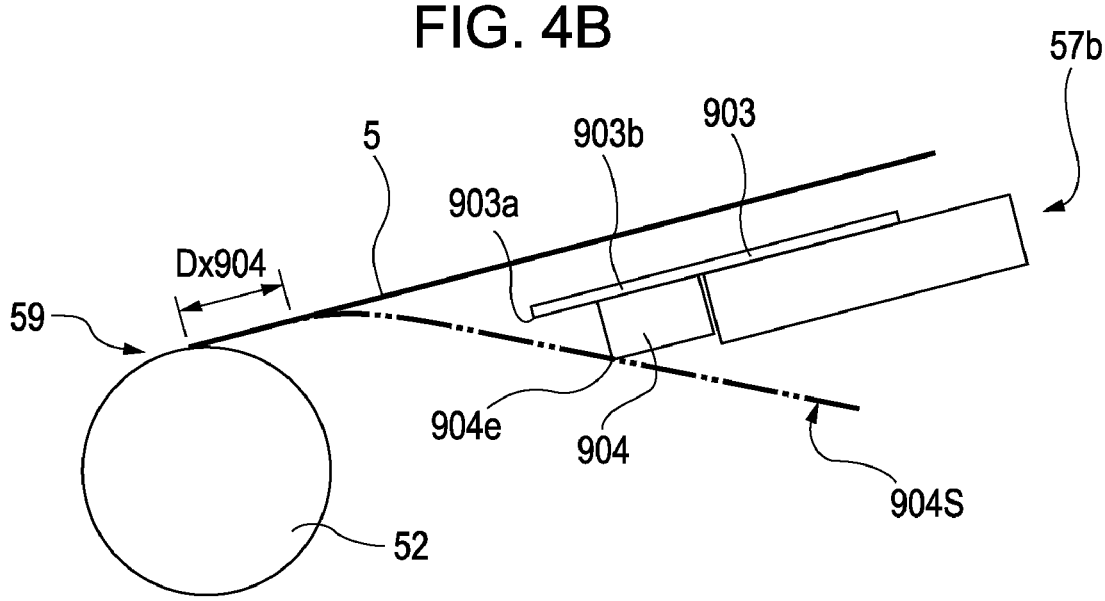
FIG. 4B is an explanatory view showing a behavior of a sheet when passing through the pre-secondary-transfer guide in a case where a PET sheet has a regulation portion.

FIG. 4A is an explanatory view showing a behavior of a sheet in a case where the PET sheet 903 has no regulation member, and FIG. 4B is an explanatory view showing a behavior of a sheet in a case where the PET sheet 903 has the regulation member 904. In FIG. 4A, the behavior of the sheet without the regulation member 904 is indicated by a two-dot chain line 901S, and the contact area between the sheet and the intermediate transfer belt 5 is indicated by Dx901. In FIG. 4B, the behavior of the sheet regulated by the regulation member 904 is indicated by a broken line 904S, and the contact area between the sheet and the intermediate transfer belt 5 is indicated by Dx904.

As shown in FIGS. 4A and 4B, since the movement of the sheet S toward the intermediate transfer belt 5 is regulated by the regulation member 904, the contact area between the sheet and the intermediate transfer belt 5 can be narrowed (reduced in size) as compared with the case without the regulation member 904.

Second Embodiment

Next, a second embodiment of the present invention is described.

Figure 6:
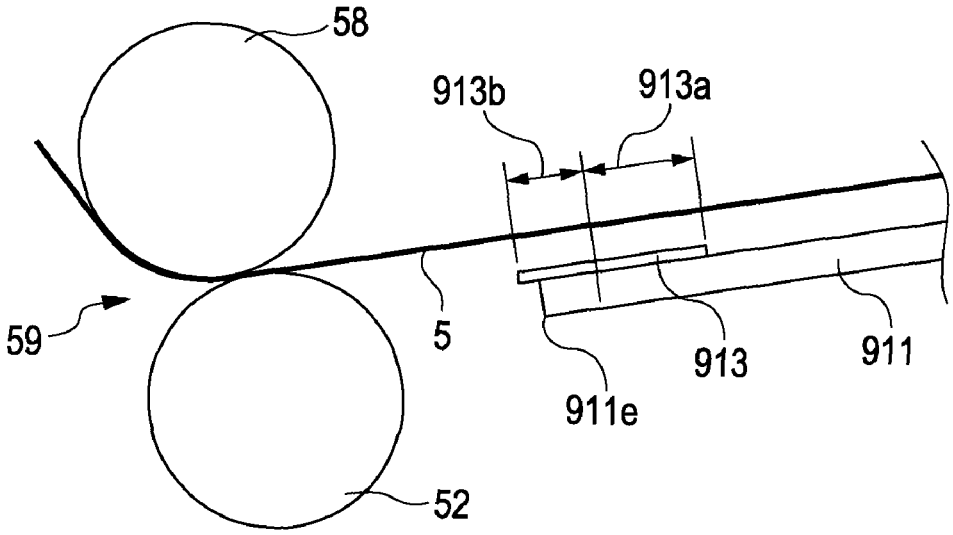
FIG. 6 is an explanatory view showing a configuration of a pre-secondary-transfer guide provided at a sheet-conveying device according to a second embodiment of the present invention.

FIG. 6 is a schematic illustration showing a pre-secondary-transfer guide provided at a sheet-conveying device according to this embodiment.

In FIG. 6, an upper guide 911 (first guide) can be made of a metal plate, and a PET sheet 913 is attached at the upper tip end portion (at the downstream side in the sheet-conveying direction) of the upper guide 911. The PET sheet 913 is a flexible member with a thickness of about 50 μm. In this embodiment, a rear end portion in the sheet-conveying direction (upstream side) of the PET sheet 913 (second guide) is attached to the upper guide 911. Since the rear end portion in the sheet-conveying direction is attached, the tip end portion of the PET sheet 913 may be bent vertically. In FIG. 6, reference numeral 913*a* denotes a bonding area of the PET sheet 913 with respect to the upper guide 911, and 913*b* denotes a movable area (flexible area) of the PET sheet 913.

Reference numeral 911*e* denotes an edge (first contact portion) of the upper guide 911 located at the downstream end. In this embodiment, when the sheet passes through the pre-secondary-transfer guide 57, the movement of the sheet toward the intermediate transfer belt 5 is regulated by the edge 911*e*. In other words, in the case where the PET sheet 913 is attached to the upper guide 911 in this embodiment, the edge 911*e* of the upper guide 911 defines the regulation portion that regulates the movement of the sheet toward the intermediate transfer belt 5.

Next, a behavior of the sheet when passing through the pre-secondary-transfer guide 57 with the above configuration is described.

The movement of the sheet toward the intermediate transfer belt 5 is regulated by the edge 911*e* provided at the lower tip end portion of the upper guide 911 in a period from when the sheet enters the secondary transfer portion 59 until when the rear end of the sheet reaches the edge 911*e* of the upper guide 911. When the rear end of the sheet passes the upper guide 911, the rear end of the sheet contacts a tip end edge 913*e* (second contact portion) of the PET sheet 913 due to the hardness of the sheet. At this time, since the rear end portion of the sheet tends to be bent toward the intermediate transfer belt 5, the tip end portion of the PET sheet 913 is bent toward the intermediate transfer belt 5 while the rear end portion of the sheet passes the tip end edge 913*e* of the PET sheet 913. In the movable area 913*b* shown in FIG. 6, the PET sheet 913 is bent from the position thereof at the upstream side of the edge 911*e* of the upper guide 911 in the sheet-conveying direction.

As described above, the degree of image rubbing due to the contact between the sheet and the intermediate transfer belt 5 depends on the sheet-supporting (regulation) position of the upper guide 911. As the sheet-supporting position comes away from the intermediate transfer belt 5 and comes close to the secondary transfer portion 59 in the sheet-conveying direction, the degree of image rubbing is improved. In this embodiment, since the edge 911*e* of the upper guide 911 is located below the PET sheet 913, is distant from the intermediate transfer belt 5, and is close to the secondary transfer portion 59 in the sheet-conveying direction, the image rubbing hardly occurs.

In addition, when the rear end portion of the sheet is released from the PET sheet 913, the tip end portion of the PET sheet 913 is bent due to the hardness of the sheet. Accordingly, the rapid change in posture of the sheet may be reduced. At this time, the bending amount of the PET sheet 913, i.e., the shock-reducing amount of the PET sheet 913 for a shock applied to the sheet when the sheet is released from the guide (hereinafter, referred to as guide-release shock) varies depending on the length of the movable area 913*b*. As the movable area 913*b* is long, the horizontal line appearing in the images due to the guide-release shock is improved.

In this embodiment, the PET sheet 913 is bonded and fixed to the upper guide 911 so that the movable area 913*b* (elastically deformable portion) of the PET sheet 913 is sufficiently provided. The movable area 913*b* (flexible portion) of the PET sheet 913 extends to the downstream end thereof from a position thereof at the upstream side of the edge 911*e* of the upper guide 911 that regulates the movement of the sheet toward the intermediate transfer belt 5.

With this configuration, the flexible portion of the PET sheet 913 can be provided sufficiently in the sheet-conveying direction. As a result, the bending amount of the PET sheet 913 when being pushed by the rear end portion of the sheet can be also provided sufficiently. Accordingly, the tip end portion of the PET sheet 913 being bent guides the rear end portion of the sheet at a position close to the intermediate transfer belt 5. This may reduce the rapid change in posture of the sheet when the rear end of the sheet passes through the pre-secondary-transfer guide 57, thereby preventing the horizontal line from appearing in the images to be transferred on the sheet.

In this embodiment, the edge 911*e* of the upper guide 911 extends toward the secondary transfer portion, so as to improve the image rubbing due to the contact between the sheet and the toner images formed on the intermediate transfer belt 5. In particular, the movable area 913*b* is determined to be about 5 mm in order to reduce the rapid change in posture of the sheet, to sufficiently provide the elastically deformable portion of the PET sheet 913, and to determine the bending amount of the PET sheet 913 so as not to contact the intermediate transfer belt 5.

Figure 2:
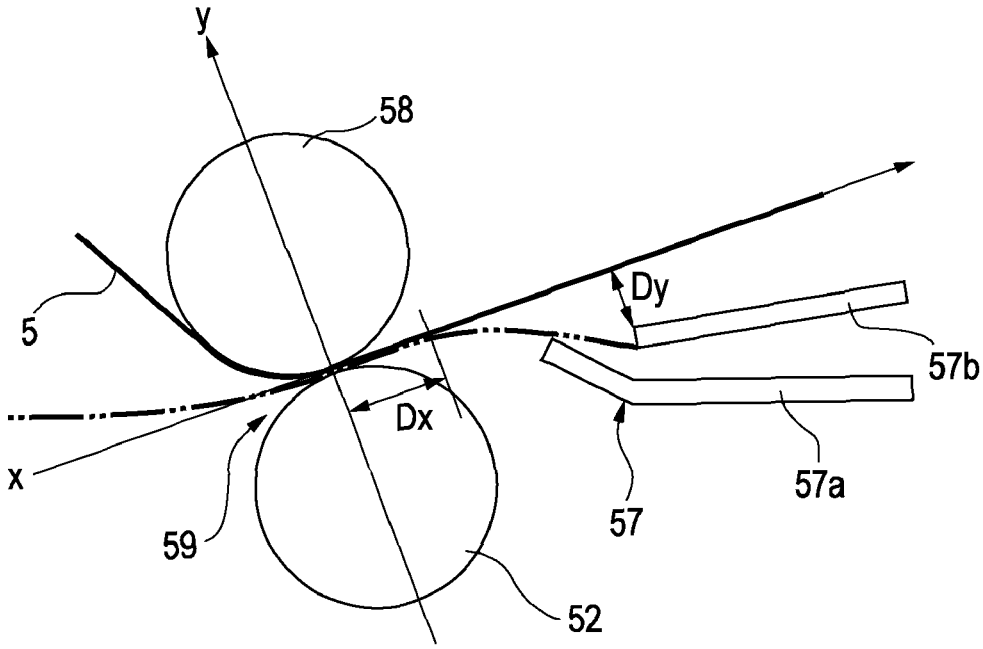
FIG. 2 is an explanatory illustration showing a configuration of a known pre-secondary-transfer guide.

FIG. 2 shows a known configuration in which a sheet is guided to the secondary transfer portion 59 using the upper guide 57*b* made of metal. Assume that an origin is an intersection point of the surface of the intermediate transfer belt 5 and a center line of the secondary transfer roller 52 and the secondary-transfer inner roller 58; x-axis is the tangential direction of the intermediate transfer belt 5; and y-axis is the center line direction. As shown in FIG. 2, Dx is an area where the sheet contacts the intermediate transfer belt 5, and Dy is a distance between the intermediate transfer belt 5 and the sheet-supporting position, i.e., the edge at the lower tip end portion of the upper guide 57*b*. In the configuration shown in FIG. 2, the tip end of the upper guide 57*b* is distant from the intermediate transfer belt 5. Accordingly, Dx becomes small, and the image rubbing can be prevented. However, since Dy is large, a line may appear in an image to be transferred due to the rapid change in posture of the sheet when the rear end of the sheet passes the upper guide 57*b* made of metal.

Herein, a flexible member may be additionally provided at the tip end portion of the upper guide 57*b* so as to receive the rear end of the sheet that moves toward the image-bearing member. The above-mentioned two embodiments of the present invention are compared with two comparative examples in which flexible members are attached to the tip end portions of upper guides. The flexible member guides the sheet to extend along the intermediate transfer belt 5 so as to provide good transcription. The flexible member is necessary to be attached in view of attachment error such that the tip end portion of the flexible member does not contact the intermediate transfer belt 5. Owing to this, the secondary transfer portion 59 is required to be away from the tip end portion of the flexible member by a predetermined distance.

Figure 7:
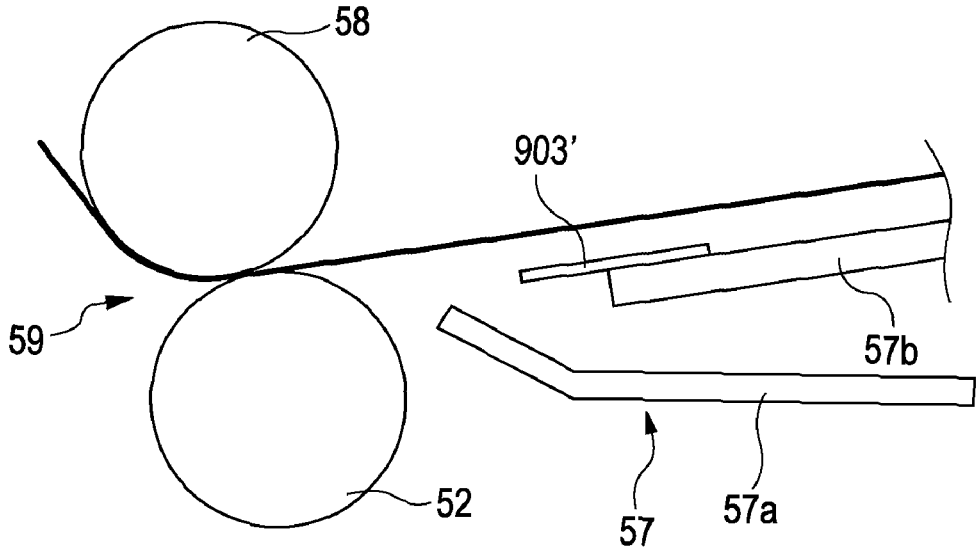
FIG. 7 is an illustration showing Comparative Example 1.

FIG. 7 shows a pre-secondary-transfer guide 57 having a flexible member 903' attached at the tip end portion of the upper guide 57*b* as a comparative example with respect to the first embodiment (hereinafter, referred to as Comparative Example 1). In the case of this pre-secondary-transfer guide 57, when the rear end of the sheet passes through the pre-secondary-transfer guide 57, appearance of a line in the images due to the guide-release shock is suppressed because the flexible member 903' is bent.

However, since the tip end portion of the flexible member 903' is distant from the lower guide 57*a*, Dx (see FIG. 2) may not become small. Accordingly, the image rubbing due to the contact between the sheet and the intermediate transfer belt 5 may not be suppressed.

Figure 8:
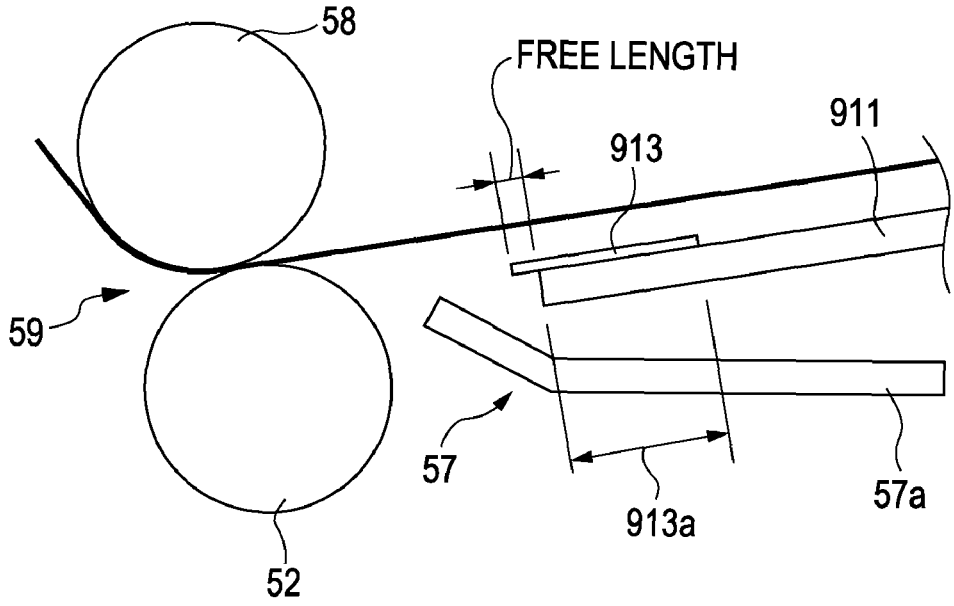
FIG. 8 is an illustration showing Comparative Example 2.

FIG. 8 shows a pre-secondary-transfer guide 57 in which the tip end portion of the upper guide 911 extends toward the secondary transfer position as compared with Comparative Example 1, and a bonding area 913*a* of the PET sheet 913 with respect to the upper guide 911 extends to the tip end thereof, as a comparative example with respect to the second embodiment (hereinafter, referred to as Comparative Example 2).

In the case of this pre-secondary-transfer guide 57, since the tip end portion of the upper guide 911 is provided at a position close to the secondary transfer position, the edge located at the lower tip end portion of the upper guide 911 that supports the sheet is located close to the secondary transfer portion 59 as compared with Comparative Example 1. Thus, Dx becomes small. Accordingly, rubbing of the sheet against the toner images formed on the intermediate transfer belt 5 (image rubbing) may be reduced.

However, since the bonding area 913*a* of the PET sheet 913 extends to the tip end portion of the upper guide 911, the length of an elastically deformable portion of the PET sheet 913 is small. As a result, the shock-reducing amount of the PET sheet 913 for the shock (guide-release shock) applied to the sheet when the rear end of the sheet passes through the guide becomes insufficient, and a line may appear in the images to be transferred due to the guide-release shock.

The results are shown in Table 1.

TABLE 1

| Upper guide | Image rubbing on belt | Guide-release shock |
|---|---|---|
| [Comparative Example 1] Flexible member added | Not good | Good |
| [Comparative Example 2] Flexible member provided and tip end of upper guide extended | Good | Not good |
| [First embodiment] Flexible member and sheet-supporting member provided | Good | Good |
| [Second embodiment] Large free length of flexible member provided and tip end of upper guide extended | Good | Good |

As shown in Table 1, with the configurations of the pre-secondary-transfer guides 57 according to the first and second embodiments, the sheet can be conveyed without contacting the toner images formed on the intermediate transfer belt 5, or without causing a line to appear in the rear end portion of the sheet. Accordingly, an image-forming apparatus capable of outputting good images for a long term can be provided.

Third Embodiment

Next, a third embodiment of the present invention is described below with reference to FIG. 9. In the third embodiment, a protrusion (regulation portion) is provided at a side of the PET sheet opposite to the intermediate transfer belt 5. Also, the PET sheet is attached at the upper guide 57*b* such that the PET sheet is bent from a position thereof at the upstream side of the downstream end of the upper guide 57*b*.

Figure 9:
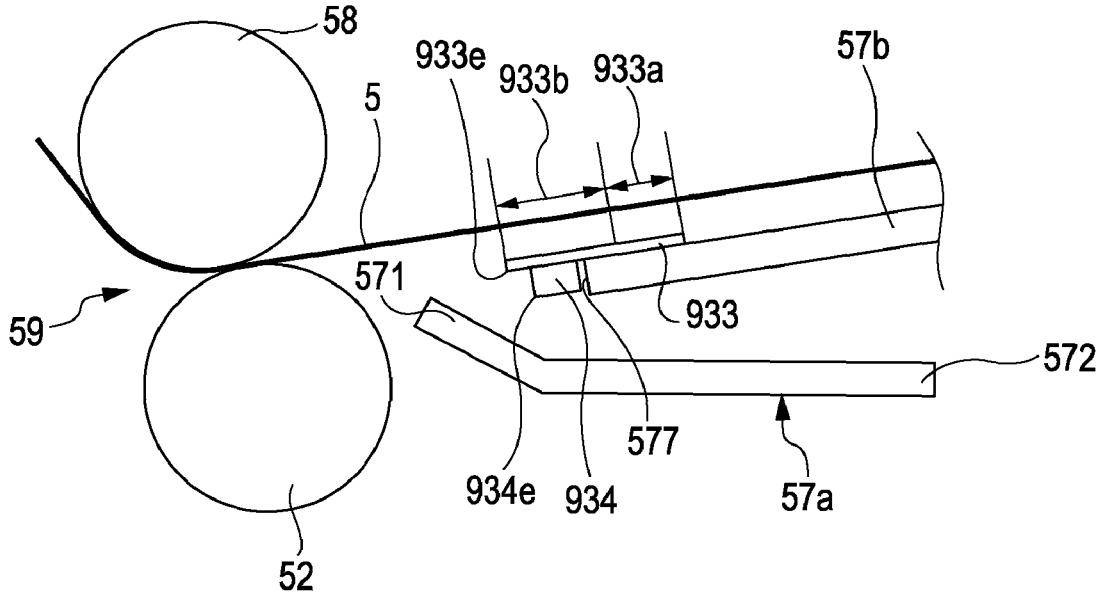
FIG. 9 is an explanatory view showing a configuration of a pre-secondary-transfer guide provided at a sheet-conveying device according to a third embodiment of the present invention.

In FIG. 9, reference numeral 933 denotes a flexible PET sheet bonded to the upper guide 57*b*. The rear end portion of the PET sheet 933 in the sheet-conveying direction (upstream side) is attached to the upper guide 57*b*. Since the rear end portion of the PET sheet 933 in the sheet-conveying direction is attached, the tip end portion of the PET sheet 933 is bent vertically. In FIG. 9, reference numeral 933*a* denotes a bonding area of the PET sheet 933 with respect to the upper guide 57*b*, and 933*b* denotes a movable area (flexible area) of the PET sheet 933. In this way, the PET sheet 933 is bonded to the upper guide 57*b* such that the PET sheet 933 is bent from a position thereof at the upstream side of a downstream end 577 of the upper guide 57*b*.

In addition, a regulation member 934 is attached to the lower surface (facing the lower guide 57*a*) of a portion of the PET sheet 933 protruding from the downstream end 577 of the upper guide 57*b*. The regulation member 934 serves as a regulation portion that regulates the movement of the PET sheet 933 toward the intermediate transfer belt 5.

In the third embodiment, the sheet is supported by the edge portion 934*e* of the regulation member 934 during the transfer. Accordingly, the area where the sheet contacts the intermediate transfer belt 5 is reduced at the upstream side of the secondary transfer portion 59. Thus, the rubbing of the sheet against the toner images formed on the intermediate transfer belt 5 may be reduced.

In addition, when the rear end of the sheet passes the regulation member 934, the rear end portion of the sheet is bent toward the intermediate transfer belt 5 in accordance with the hardness of the sheet. The rear end portion of the bent sheet contacts the tip end portion of the flexible PET sheet 933, so that the PET sheet 933 is bent. The shock due to the rapid change in posture of the rear end portion of the sheet may be reduced because the PET sheet 933 is bent. When the rear end portion of the sheet contacts a tip end edge 933*e* of the PET sheet 933 and hence the PET sheet 933 is bent, the PET sheet 933 is supported such that the PET sheet 933 is bent from the position thereof at the upstream side of the downstream end 577 of the upper guide 57*b*. That is, since the movable area 933*b* of the PET sheet 933 is long, the shock due to the change in posture of the rear end portion of the sheet may be further reduced by the PET sheet 933.

In the above embodiments, the configurations have been applied to a case where a toner image on the intermediate transfer belt is transferred on a sheet. However, the configurations may be applied to a case where a toner image on a photosensitive drum as an image-bearing member is transferred on a sheet.

Figure 10:
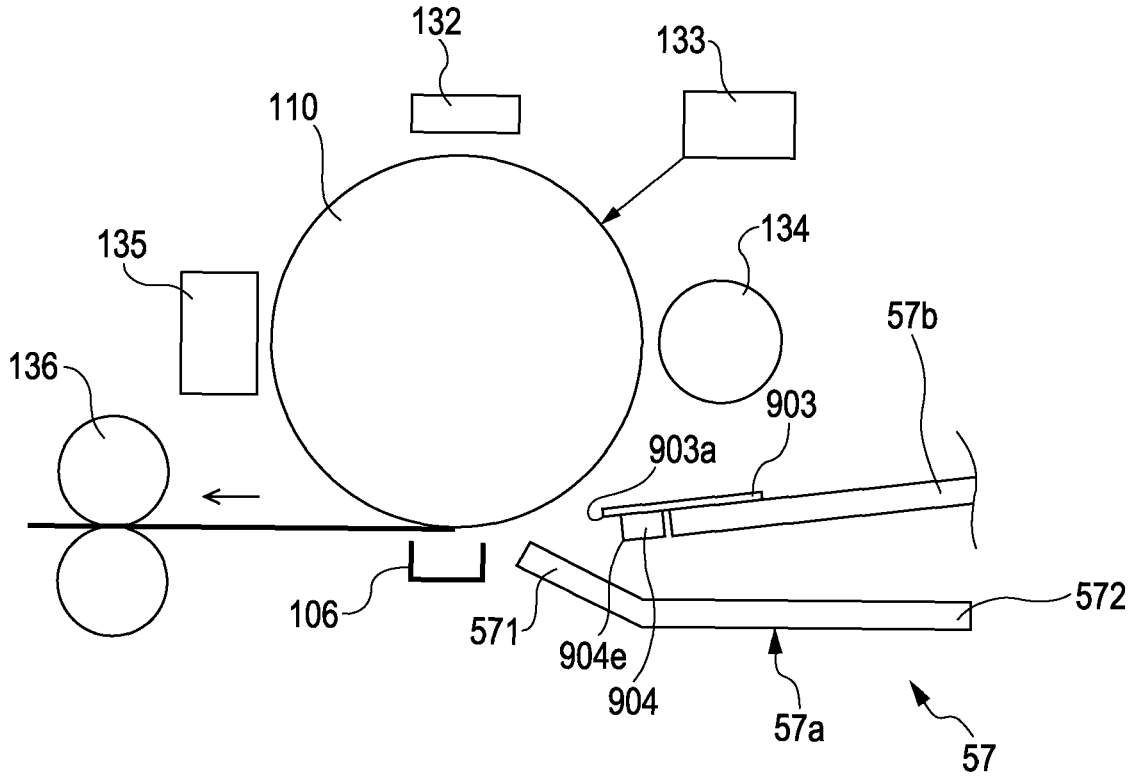
FIG. 10 is an explanatory illustration showing an embodiment which uses a photosensitive drum as an image-bearing member.

FIG. 10 shows the pre-secondary-transfer guide described in the first embodiment applied to an arrangement in which a toner image on the photosensitive drum is transferred on a sheet. A charger 132, an optical unit 133, a developer 134, a transfer unit 106, and a cleaner 135 are arranged around a photosensitive drum 110. A toner image developed by the developer 134 to be a latent image is transferred on a sheet conveyed by the transfer unit 106, and the image is fixed by a fixing unit 136. The sheet is guided to the transfer unit 106 by the pre-transfer guide 57 before the transfer.

The pre-transfer guide 57 is similar to the pre-secondary-transfer guide of the first embodiment. In this configuration, for instance, even when the sheet is curved, the sheet can be prevented from rubbing the toner image formed on the photosensitive drum 110 at the upstream side of the transfer unit 106. In addition, after the rear end of the sheet passes the regulation member 904 of the pre-transfer guide 57, the PET sheet 903 is bent from the position thereof at the upstream side of the lower edge 904*e* which is the downstream end of the regulation member 904, the change in posture of the sheet can be reduced by the PET sheet 903, thereby hardly causing a line to appear in the image.

While the pre-secondary-transfer guide described in the first embodiment is applied to the configuration in which the photosensitive drum serves as the image-bearing member, the pre-secondary-transfer guide described in the second or third embodiment may be applied to such a configuration.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-212614 filed Aug. 3, 2006, which is hereby incorporated by reference herein in its entirety.

What is claimed is:

1. An image-forming apparatus comprising:

an image-bearing member supporting a toner image;

a transfer portion at which the toner image on the image-bearing member is transferred on a sheet;

a first guide configured to guide the sheet to the transfer portion, the first guide having a first contact portion that is a downstream edge of the first guide in a conveying direction, a surface of the sheet on which the toner image is transferred contacting the first contact portion; and a flexible second guide configured to guide the sheet to the transfer portion, the second guide having a second contact portion, the surface of the sheet on which the toner image is transferred contacting the second contact portion, wherein the first contact portion is located on an upstream side of the second contact portion in a sheet-conveying direction, wherein after a rear end of the sheet passes the first contact portion, the rear end of the sheet passes the second contact portion while the sheet causes the second guide to bend toward the image-bearing member, and wherein by a force from the sheet, the second guide is bent from a position thereof at an upstream of the first contact portion in the sheet-conveying direction.

2. The image-forming apparatus according to claim 1, wherein the first guide protrudes from an elastically deformable portion of the second guide toward a side opposite to the image-bearing member.

3. The image-forming apparatus according to claim 1, wherein the first guide supports the second guide such that the second guide is bent from the position thereof at the upstream of the first contact portion in the sheet-conveying direction.

4. The image-forming apparatus according to claim 1, further comprising a photosensitive drum, wherein the image-bearing member is an intermediate transfer belt on which a toner image on the photosensitive drum is transferred, and wherein the transfer portion is a nipping portion between a transfer roller for transferring the toner image on the intermediate transfer belt on a sheet and the intermediate transfer belt.

5. An image-forming apparatus comprising:

an image-bearing member supporting a toner image;

a transfer portion at which the toner image on the image-bearing member is transferred on a sheet;

a first guide configured to guide the sheet to the transfer portion, a surface of the sheet on which the toner image is transferred contacting the first guide; and a flexible second guide configured to guide the sheet to the transfer portion, the surface of the sheet on which the toner image is transferred contacting the second guide, wherein a downstream end of the first guide in a sheet-conveying direction is located on an upstream of a downstream end of the second guide in a sheet-conveying direction, wherein after a rear end of the sheet passes the first guide, the rear end of the sheet passes the second guide while the sheet causes the second guide to bend toward the image-bearing member, and wherein by a force from the sheet, the second guide is bent from a position thereof at the upstream of the downstream end of the first guide in the sheet-conveying direction.

6. The image-forming apparatus according to claim 5, wherein the first guide protrudes from an elastically deformable portion of the second guide toward a side opposite to the image-bearing member.

7. The image-forming apparatus according to claim 5, wherein the first guide supports the second guide such that the second guide is bent from the position of an upstream in the sheet-conveying direction with respect to the first contact portion.

8. The image-forming apparatus according to claim 5, further comprising a photosensitive drum, wherein the image-bearing member is an intermediate transfer belt on which a toner image on the photosensitive drum is transferred, and wherein the transfer portion is a nipping portion between a transfer roller for transferring the toner image on the intermediate transfer belt on a sheet and the intermediate transfer belt.

* * * * *